US011084648B2

(12) United States Patent
DeGraaf

(10) Patent No.: US 11,084,648 B2
(45) **Date of Patent: *Aug. 10, 2021**

(54) PERSONAL PROTECTION EQUIPMENT DISPENSERS

(71) Applicant: Bowman Dispensers, LLC, Caledonia, MI (US)

(72) Inventor: Danté G. DeGraaf, Lake Stevens, WA (US)

(73) Assignee: PNC Bank, National Association, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/545,971

(22) Filed: Aug. 20, 2019

(65) Prior Publication Data

US 2019/0367255 A1 Dec. 5, 2019

Related U.S. Application Data

(63) Continuation of application No. 15/480,803, filed on Apr. 6, 2017, now Pat. No. 10,384,856, which is a continuation of application No. 14/288,105, filed on May 27, 2014, now Pat. No. 9,624,027.

(60) Provisional application No. 61/832,099, filed on Jun. 6, 2013.

(51) Int. Cl.

| | |
|---|---|
| ***B65D 83/08*** | (2006.01) |
| ***B65D 25/00*** | (2006.01) |
| ***B65D 25/10*** | (2006.01) |
| ***B65D 25/22*** | (2006.01) |

(52) U.S. Cl.
CPC ..... *B65D 83/0817* (2013.01); *B65D 25/005* (2013.01); *B65D 25/10* (2013.01); *B65D 25/22* (2013.01)

(58) Field of Classification Search
CPC .. B65D 83/0817; B65D 25/005; B65D 25/10; B65D 25/22
See application file for complete search history.

(56) References Cited

U.S. PATENT DOCUMENTS

| | | | |
|---|---|---|---|
| 2,640,587 | A | 6/1953 | Smith |
| 2,911,175 | A | 11/1959 | Erie |
| 3,269,593 | A | 8/1966 | Madeleine et al. |
| 3,606,082 | A | 9/1971 | Kuchenbecker |
| 3,982,659 | A | 9/1976 | Ross |
| 4,408,811 | A | 10/1983 | Richardson et al. |
| 4,678,099 | A | 7/1987 | Matsui |
| 4,863,064 | A | 9/1989 | Dailey |
| 5,255,971 | A | 10/1993 | Aisley |

(Continued)

*Primary Examiner* — Shawn M Braden
(74) *Attorney, Agent, or Firm* — The Dobrusin Law Firm, PC

(57) ABSTRACT

A dispenser adapted to be mounted to a structure wall and to allow consumables to be dispensed from a consumables box, the dispenser comprising a front wall, at least one back wall, first and second walls, and at least one support wall. The front wall defines and extends completely around an aperture. The first and second walls each extend between the front wall and the at least one back wall. The at least one support wall extends from at least one of the front wall, the at least one back wall, and the first and second walls. The consumables box is supported by the at least one support wall such that a first portion defined by the at least one back wall is configured to engage the consumables box and a second portion defined by one of the first and second walls is configured to engage the consumables box.

19 Claims, 5 Drawing Sheets

(56) References Cited

U.S. PATENT DOCUMENTS

| | | | |
|---|---|---|---|
| 5,405,196 | A | 4/1995 | Shoup et al. |
| 5,484,196 | A | 1/1996 | Kim |
| 5,528,810 | A | 6/1996 | Eddy et al. |
| 5,562,163 | A | 10/1996 | Sartain et al. |
| 5,624,170 | A | 4/1997 | Hasty |
| 5,647,506 | A | 7/1997 | Julius |
| 5,950,382 | A | 9/1999 | Martino |
| 6,053,357 | A | 4/2000 | Yoh |
| 6,089,685 | A | 7/2000 | Ryan et al. |
| D445,028 | S | 7/2001 | Grubstein |
| 6,296,181 | B1 | 10/2001 | Noblet et al. |
| 6,651,827 | B1 | 11/2003 | Eberwein |
| D493,312 | S | 7/2004 | Collins et al. |
| 6,820,753 | B2 | 11/2004 | Kurtz |
| 6,913,369 | B2 | 7/2005 | Chadwick |
| 7,004,435 | B2 | 2/2006 | Formon |
| D520,277 | S | 5/2006 | Smiley et al. |
| D524,084 | S | 7/2006 | Wieser et al. |
| D526,165 | S | 8/2006 | Burns et al. |
| D550,008 | S | 9/2007 | Hager et al. |
| D552,428 | S | 10/2007 | Zeiron |
| D579,249 | S | 10/2008 | Omdoll et al. |
| D590,213 | S | 4/2009 | Young et al. |
| 7,543,719 | B2 | 6/2009 | Young et al. |
| D604,996 | S | 12/2009 | Kuehneman et al. |
| D604,997 | S | 12/2009 | Kuehneman et al. |
| 7,721,913 | B2 | 5/2010 | Nash et al. |
| 7,762,635 | B2 | 7/2010 | Spoljaric |
| D626,362 | S | 11/2010 | Martin |
| D630,873 | S | 1/2011 | Kuehneman et al. |
| D648,187 | S | 11/2011 | Kuehneman et al. |
| 8,152,021 | B2 | 4/2012 | Babikian |
| D665,209 | S | 8/2012 | Vasquez |
| D669,715 | S | 10/2012 | Silagy |
| 8,424,982 | B1 | 4/2013 | Schwartz |
| D681,378 | S | 5/2013 | Murphy |
| D683,986 | S | 6/2013 | Murphy |
| D705,017 | S | 5/2014 | Siebel |
| 8,931,663 | B1 | 1/2015 | Evans et al. |
| 9,624,027 | B2 | 4/2017 | DeGraaf |
| D806,526 | S | 1/2018 | Prewitt, Jr. |
| 2004/0263029 | A1 | 12/2004 | Scholefield |
| 2005/0273958 | A1 | 12/2005 | Dillon |
| 2006/0119235 | A1 | 6/2006 | Aisley et al. |
| 2006/0243618 | A1 | 11/2006 | Brown et al. |
| 2011/0115351 | A1 | 5/2011 | McManic et al. |
| 2011/0279001 | A1 | 11/2011 | Peters et al. |
| 2011/0284567 | A1 | 11/2011 | Hatter et al. |
| 2012/0169196 | A1 | 7/2012 | Marchetti |
| 2012/0228323 | A1 | 9/2012 | Fujimoto |
| 2012/0273514 | A1 | 11/2012 | Sartini et al. |
| 2014/0361024 | A1 | 12/2014 | DeGraaf |
| 2015/0182076 | A1 | 7/2015 | Berke |
| 2015/0320238 | A1 | 11/2015 | DeGraaf |
| 2015/0374121 | A1 | 12/2015 | Wood |
| 2017/0008691 | A1 | 1/2017 | DeGraaf |
| 2017/0036847 | A1 | 2/2017 | Henson et al. |

PERSONAL PROTECTION EQUIPMENT DISPENSERS

RELATED APPLICATIONS

This application is a continuation of U.S. patent application Ser. No. 15/480,803 filed Apr. 6, 2017, currently pending.

U.S. patent application Ser. No. 15/480,803 filed Apr. 6, 2017 is a continuation of U.S. patent application Ser. No. 14/288,105 filed May 27, 2014, now U.S. Pat. No. 9,624,027 which issued on Apr. 18, 2017.

U.S. patent application Ser. No. 14/288,105 claims priority from U.S. Provisional patent Application Ser. No. 61/832,099 filed Jun. 6, 2013.

The contents of all related applications are incorporated herein by reference in their entireties.

FIELD OF THE INVENTION

The present invention generally relates to personal protection equipment (PPE) dispensers for organizing and dispensing consumable goods such as, but not limited to, gloves, facemasks, gowns, wipes, and pads for industries such as, but not limited to, medical, healthcare, education, foodservice, automotive, and industrial.

BACKGROUND

FIG. 1 shows a conventional dispenser 10 that takes the form of a spring loaded dispenser produced from a single sheet of material. The conventional dispenser 10 includes a spring mechanism 12 in the form of an angled flange configured to urge a consumables box (not shown) forward so the consumable products may be withdrawn from an aperture 14 in the conventional dispenser 10 and a corresponding aperture (not shown) in the box, The conventional dispenser 10 is typically made from a single piece of material (e.g., non-finished plastic, powder coated metals, and stainless steel). The conventional dispenser 10 includes a top edge 16 and a bottom edge 18. A back plate 20 takes the form of a continuous back plate. The side plates 22 takes the form of continuous side plates integrally formed with the continuous back plate 20. The front plates 24, 26 are bent relative to the continuous side plates 22, but the front plates 24, 26 not connected, which in turn permits the aperture 14 to extend openly from the top edge 16 of the dispenser to the bottom edge 18 of the dispenser. A bottom shelf 28 extends from the back plate 20 to support the consumables box (not shown).

SUMMARY

The present invention generally relates to dispensers for holding a consumables box containing consumable products such as, but not limited to, disposable latex gloves. In one embodiment, the dispenser includes a continuous front plate with an aperture for extracting the consumable products, continuous side plates, and separable back plates that develop a load path with the continuous front plate after the dispenser has been mounted onto a mounting surface. The dispenser may include one or more spring mechanisms that urge the consumables box into a for and centered position within the dispenser. The continuous front plate resists undesired deflection when subjected to an outward force. In another embodiment, one or more surfaces of the dispenser may be overlaid with a woodgrain laminate for aesthetic purposes.

In one aspect of the present invention, a dispenser includes a plurality of bottom shelves configured to support a consumables box containing consumable products; a continuous front plate having an aperture configured to extract the consumable products from the consumables box; continuous side plates integrally formed with the continuous front plate; and back plates separable by a cut, the back plates integrally formed with the continuous side plates. Further, the dispenser, when mounted to a mounting surface, permits one or more outward forces applied to the continuous front plate to be transmitted to the mounting surface without causing an undesirable amount of displacement of the continuous front plate.

In another aspect of the present invention, a forming method for a dispenser includes the steps of (1) obtaining a single sheet of material; (2) cutting an aperture into a continuous front plate of the material; (3) bending the material to form continuous side plates; (4) bending the material to form back plates separable by abuttable free edges of the single sheet of material; and, (5) bending the continuous front plate, the continuous side plate and the back plates to form a bottom shelf configured to support a consumables box.

The present invention may be embodied as a dispenser adapted to be mounted to a structure wall and to allow consumables to be dispensed from a consumables box, the dispenser comprising a front wall, at least one back wall, first and second walls, and at least one support wall. The front wall defines and extends completely around an aperture. The first and second walls each extending between the front wall and the at least one back wall. The at least one support wall extends from at least one of the front wall, the at least one back wall, and the first and second walls. The aperture in the front wall is configured to allow the consumables to be extracted from the consumables box. Prior to attachment of the dispenser to the structure wall, the at least one back wall is configured to allow deformation of the at least one back wall. The dispenser is attached to the structure wall by securing the at least one back wall to the structure wall, where, after attachment of the dispenser to the structure wall, the at least one back wall is fixed. The consumables box is supported by the at least one support wall such that a first portion defined by the at least one back wall is configured to engage the consumables box, a second portion defined by one of the first and second walls is configured to engage the consumables box, and when the dispenser is attached to the structure wall, the front wall and the at least one back wall inhibit displacement of the first and second walls relative to each other. The aperture in the front wall is configured to inhibit flexing of the dispenser when the at least one back wall and the first and second walls engage the consumables box.

The present invention may also be embodied as a method of allowing consumables to be dispensed from a consumables box comprising the following steps. A dispenser is provided, the dispenser comprising a front wall defining an aperture, at least one back wall, first and second walls each extending between the front wall and the at least one back wall, and at least one support wall extending from at least one of the front wall, the at least one back wall, and the first and second walls. The front wall extends completely around the aperture. The aperture in the front wall is configured to allow the consumables to be extracted from the consumables box and to inhibit flexing of the dispenser when the at least one back wall and the first and second walls engage the consumables box. The at least one back wall is configured to allow deformation of the at least one back wall prior to attachment of the dispenser to the structure wall. The dispenser is attached to the structure wall by securing the at least one back wall to the structure wall. After attachment of the dispenser to the structure wall, the at least one back wall is fixed. The consumables box is supported by the at least one support wall such that a first portion defined by the at least one back wall is configured to engage the consumables box, a second portion defined by one of the first and second walls is configured to engage the consumables box, and when the dispenser is attached to the structure wall, the front wall and the at least one back wall inhibit displacement of the first and second walls relative to each other.

The present invention may also be embodied as a dispenser adapted to be mounted to a structure wall and to allow consumables to be dispensed from a consumables box, the dispenser comprising a front wall, a plurality of back walls, first and second walls, and at least one support wall. The front wall defines an aperture and extends completely around the aperture. At least one first projection is integrally formed in at least one of the back walls, and at least one mounting aperture is integrally formed in each of the back walls. The first and second walls each extend between the front wall and one of the back walls, where at least one second projection is integrally formed in at least one of the first and second walls supports. The at least one support wall extends from each of the front wall, the back walls, and the first and second walls. The aperture in the front wall is configured to allow the consumables to be extracted from the consumables box. Prior to attachment of the dispenser to the structure wall, the back walls are spaced from each other such that the back walls are capable of moving relative to each other. The dispenser is attached to the structure wall by securing the back walls to the structure wall, where, after attachment of the dispenser to the structure wall, the back walls are fixed relative to each other. The consumables box is supported by the at least one support wall using the at least one mounting aperture such that the first projection engages the consumables box, the at least one second projection engages the consumables box, outward forces on the front wall of the dispenser is transmitted to the structure wall through the first and second walls and the back walls, and outward forces on the first and second walls of the dispenser are transmitted to the structure wall through the back walls. The aperture in the front wall is configured to inhibit flexing of the dispenser when the first and second outward forces are applied to the dispenser.

BRIEF DESCRIPTION OF THE DRAWINGS

In the drawings, identical reference numbers identify similar elements or acts. The sizes and relative positions of elements in the drawings may not be necessarily drawn to scale. For example, the shapes of various elements and angles may not be drawn to scale, and some of these elements may be arbitrarily enlarged or positioned to improve drawing legibility. Preferred and alternative embodiments of the present invention are described in detail below with reference to the following drawings.

DETAILED DESCRIPTION

In the following description, certain specific details are set forth in order to provide a thorough understanding of various embodiments of the invention. However, one skilled in the art will understand that the invention may be practiced without these details. In other instances, well-known structures associated with dispensers and organizers for consumable goods, assemblies and subassemblies of the same, and methods of using, assembling and installing any of the above have not necessarily been shown or described in detail to avoid unnecessarily obscuring descriptions of the embodiments of the invention.

Figure 1:
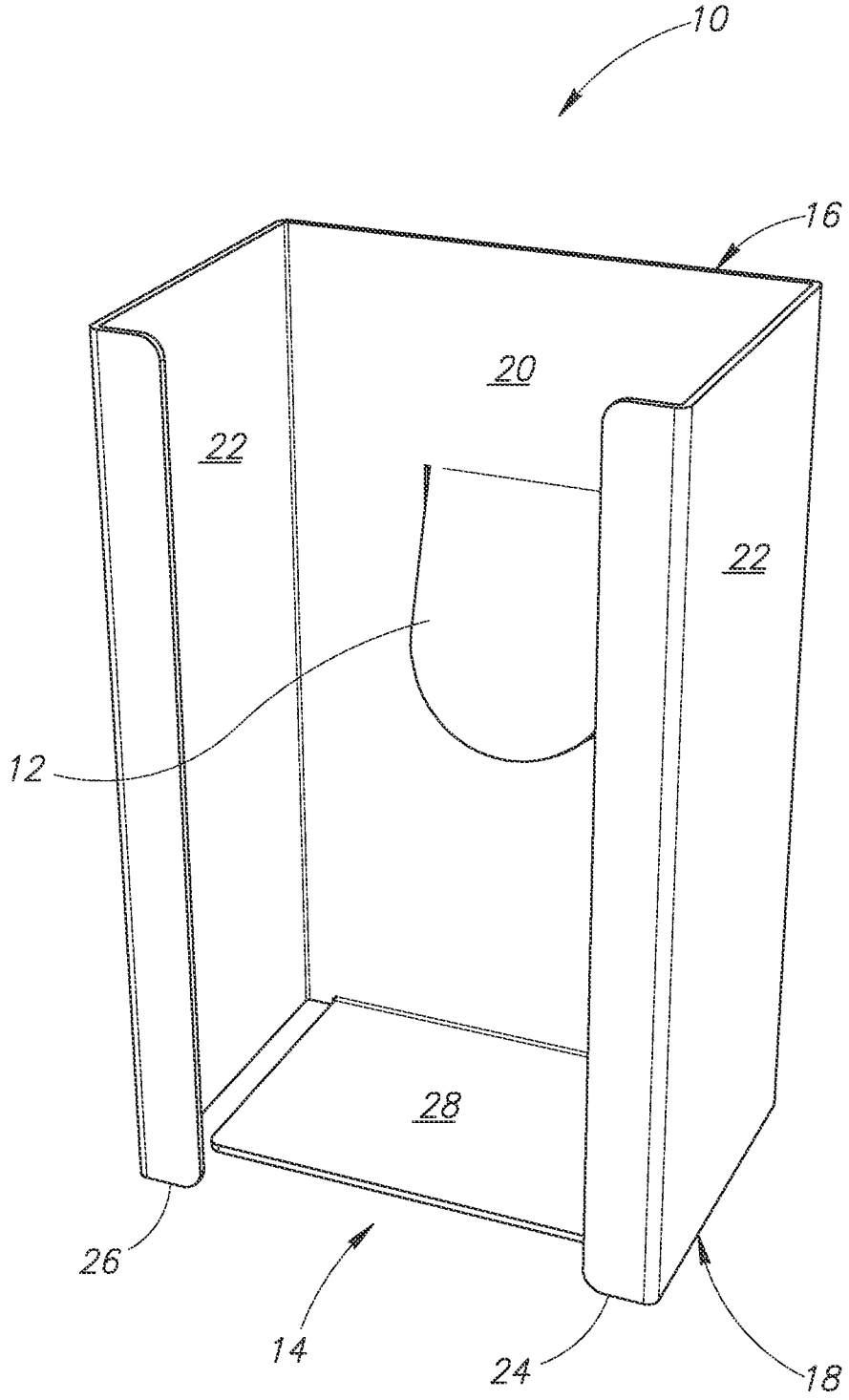
FIG.1 (PRIOR ART)
FIG. 1 is a top, front, right isometric view showing a prior-art dispenser.

The fully open, front aperture and the rigid back plate concept of the conventional dispenser 10, described above with reference to FIG. 1, leaves the conventional dispenser 10 vulnerable to side load flexing, especially when the conventional dispenser 10 is made from a relatively flexible material such as, but not limited to, a plastic material, a thin, metal material, a thin composite material, etc. As mentioned, the spring mechanism 12 urges the consumables box (not shown) forward, which places an outward force on the front plates 24, 26. In addition, pulling consumable products from the consumables box also places a dynamic, outward force on the front plates 24, 26. Often times, the application of one or both of these forces causes the front plates 24, 26 to displace or bend outward to such an extent that the consumables box falls out of the conventional dispenser 10. If spring mechanisms, such as spring mechanism 12, are added to the side plates 22 then the displacement or bending phenomena of the front plates 24, 26 may be even more pronounced.

Figure 2:
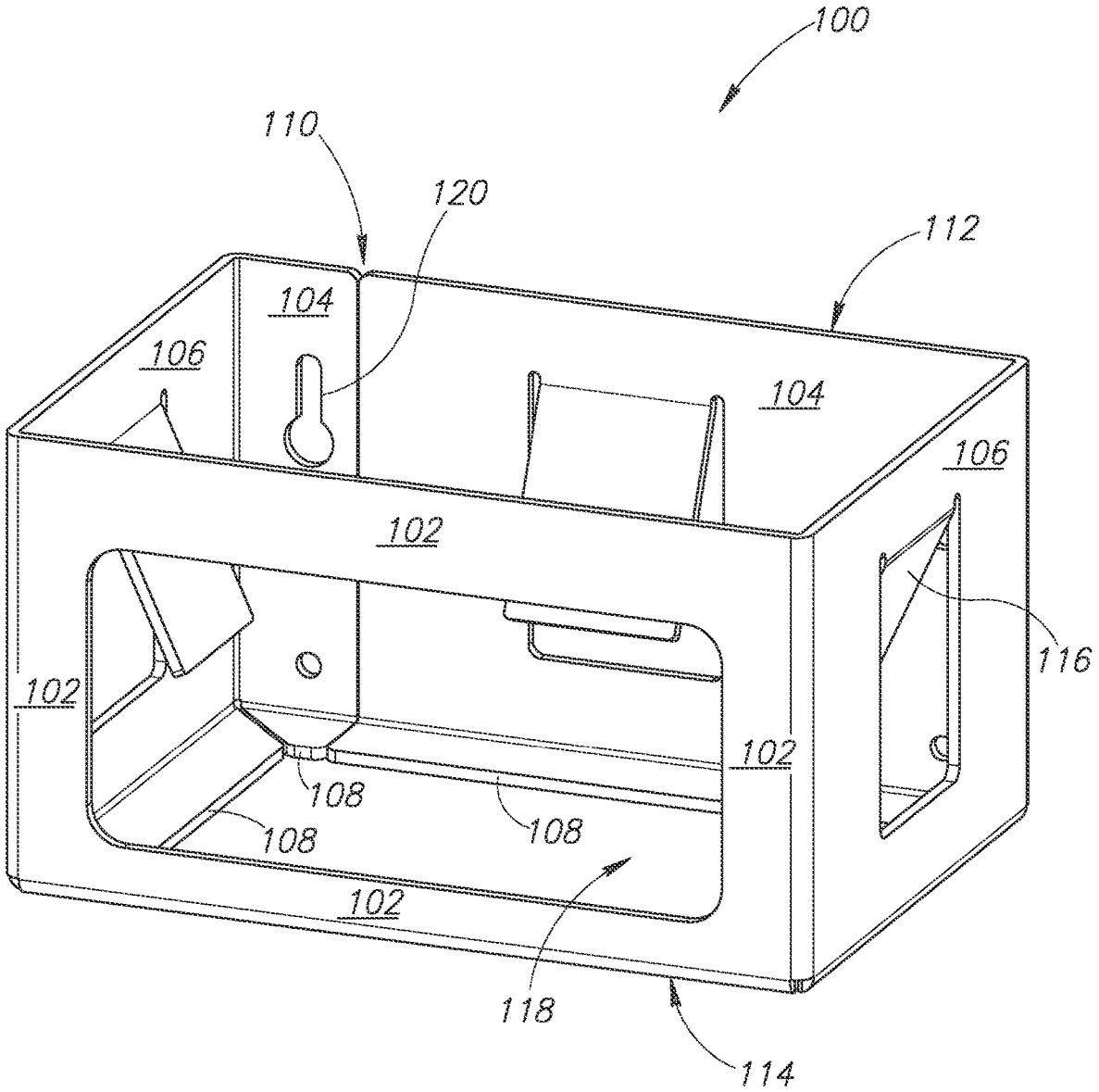
FIG. 2 is a top, front, right isometric view showing a dispenser having a continuous front plate according to an embodiment of the present invention.
Figure 3:
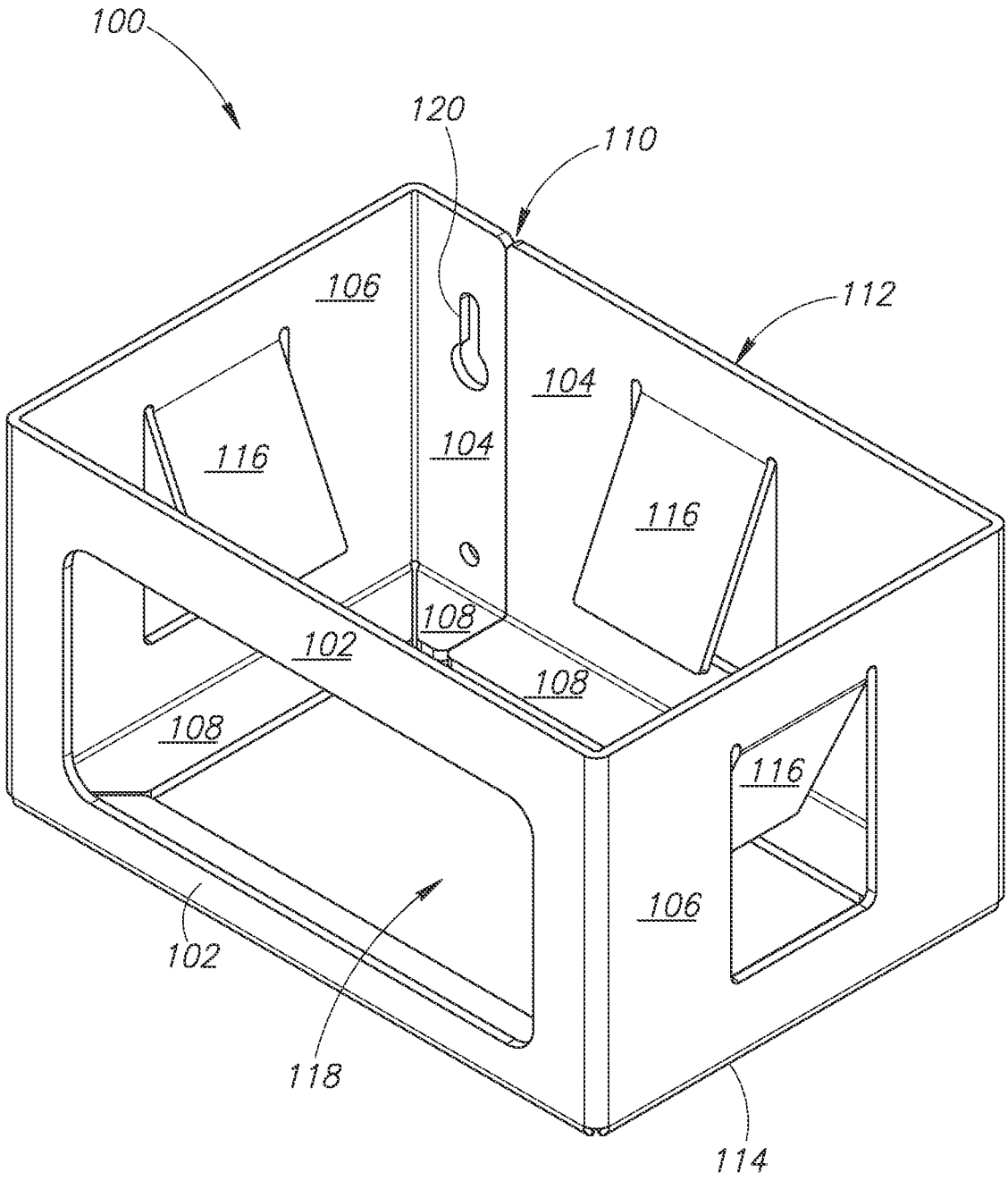
FIG. 3 is a top, front, right perspective view showing the dispenser of FIG. 2.
Figure 4:
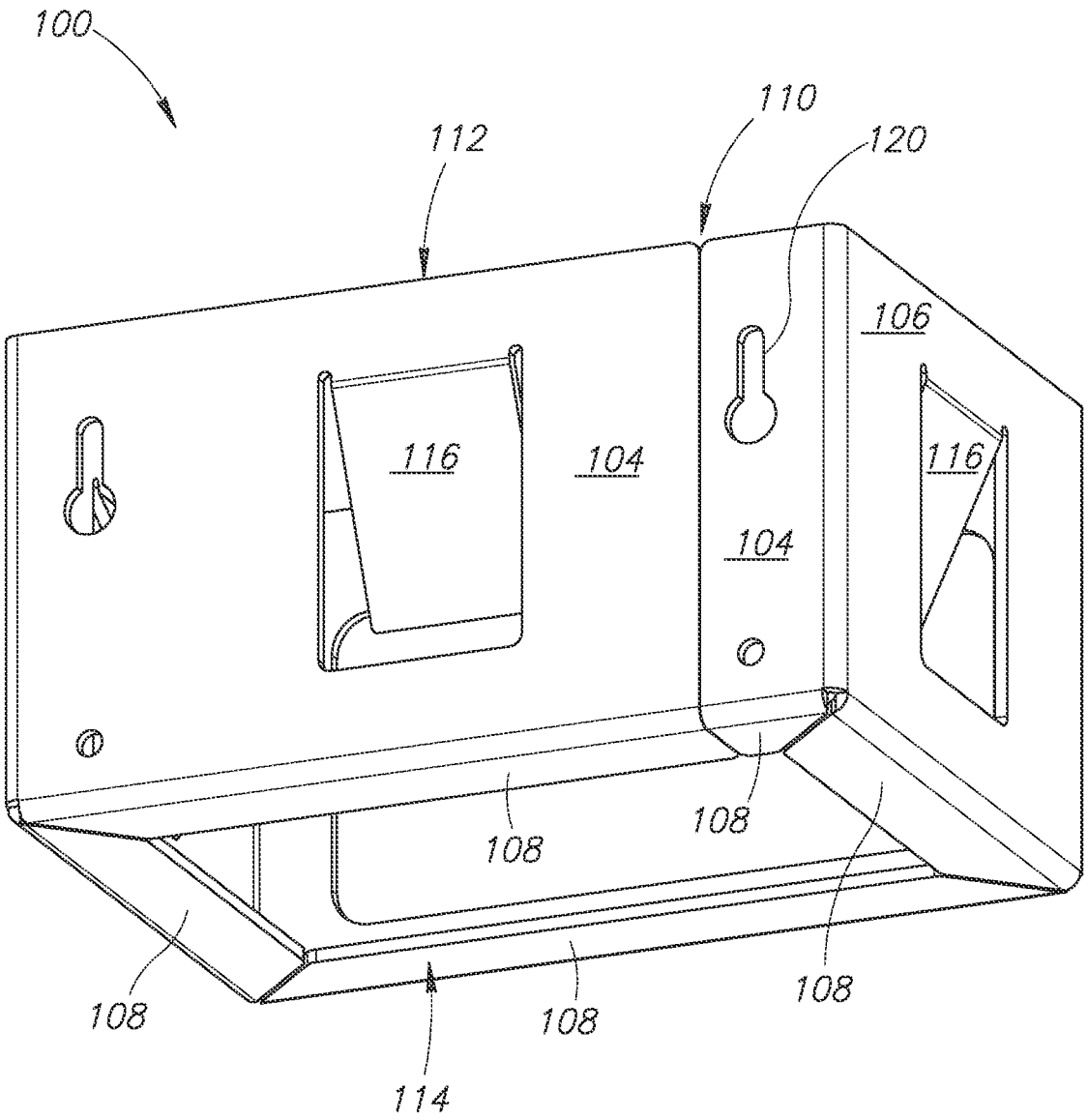
FIG. 4 is a bottom, left perspective view showing the dispenser of FIG. 2; and, FIG. 5 is a top, front, right isometric view showing a dispenser having a woodgrain laminate according to an embodiment of the present invention.

FIGS. 2-4 show a dispenser 100 having a continuous front plate 102 and separable back plates 104 according to an embodiment of the present invention. The dispenser 100 may be produced or otherwise formed from a single piece of material, which may take the form of a flat sheet before being shaped into the dispenser 100. The dispenser 100 also includes continuous side plates 106 and a plurality of bottom shelves 106 for supporting a consumables box (not shown) holding consumable products, The separable back plate 104 is separable along a cut 110 that extends through a wall thickness of the separable back plates 104 and further extends from a top edge or surface 112 of the dispenser 100 to a bottom edge or surface 114 of the dispenser 100. The cut 110 may take the form of a vertical, straight-line cut or and alternate-shaped cut extending through the dispenser 100 as previously described herein. The cut 110 permits the dispenser 100 to be flexible before mounting to a wall or other structure (not shown).

Further, the separable back plates 104 and one or more of the continuous side plates 106 may include spring mechanisms 116 in the form of integrated, angled flanges for maintaining the consumables box in a centered and forward position. The spring mechanisms 116 allow for easy extraction of the consumable products. Preferably, the spring mechanisms 116 are made of the same material as the dispenser 100. The spring mechanisms 116 may be all be the same size or may be different sizes depending on an amount of force to be applied to the consumables box in a certain direction.

The continuous front plate 102 forms an aperture 118 that permits access to the consumable products held in the consumables box (not shown). When the dispenser is mounted to a wall or other structure (not shown) using one or more mounting apertures 120, the separable back plates 104 may be placed in abutment contact along the cut 110. The mounting process advantageously allows the overall stiffness of the dispenser to be developed. Stated otherwise, an outward force applied to the continuous front plate 102, after the dispenser 100 has been mounted to a wall or other structure, would be transferred from the continuous front plate 102, then into the continuous side plates 106, then into the separable back plates 104, into mounting hardware (not shown) placed in the mounting apertures 102, and finally into the wall or other structure. Consequently, the continuous front plate 102 would not permit the consumables box to displace or bend the continuous front plate 102 to an extent where the consumables box could fall out of the dispenser 100. The mounted dispenser 100 eliminates or sufficiently reduces undesired flexing of the dispenser 100 because of the continuous front plate 102 and eliminates or sufficiently reduces undesired movement of the consumables box held within the dispenser 100.

Figure 5:
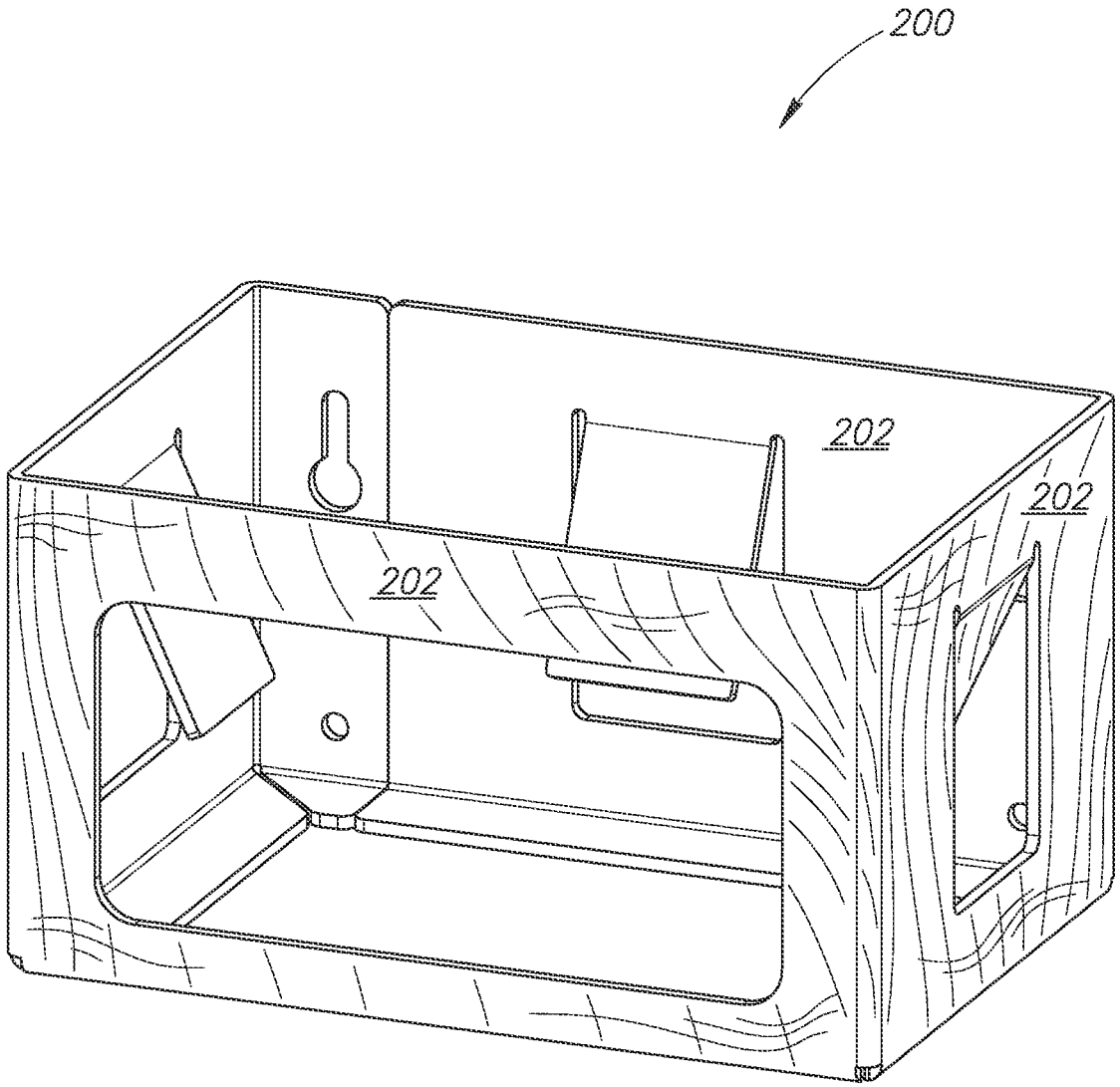

In another embodiment, FIG. 5 shows a dispenser 200 having an aesthetic, woodgrain surface 202 that may be desirable by a variety of industries that utilize dispensers. By way of example, the healthcare industry has become more focused on comfort care for patients. The healthcare industry has started to place a higher emphasis on developing a warmer environment within patient waiting areas and exam rooms, as contrasted to the cold, metallic environments of the past. Real wood and other open-cell surfaces are generally not used on furniture, cabinetry and equipment where infection or communicable illness may be transmitted. Conventional dispensers, as noted above, are made from materials such as, but not limited to, non-finished plastics, powder coated metals, and stainless steel.

In the illustrated embodiment, the woodgrain surface may take the form of a woodgrain laminate applied onto at least a visible surface of the dispenser 200 before forming. Preferably, the woodgrain laminate would be made from a closed-cell plastic material, but could be made from other materials depending on an end-customer's needs for the dispenser 200. The type, style and color of the woodgrain laminate may be selected by the end-customer (e.g., a cherry wood laminate or a pine wood laminate). In another embodiment, both the visible and non-visible surfaces of the dispenser 200 may include woodgrain surfaces 202 covered with the woodgrain laminate.

The various embodiments described above can be combined to provide further embodiments. All of the above U.S. patents, patent applications and publications referred to in this specification are incorporated herein by reference. Aspects can be modified, if necessary, to employ devices, features, and concepts of the various patents, applications and publications to provide yet further embodiments.

These and other changes can be made in light of the above detailed description. In general, in the following claims, the terms used should not be construed to limit the invention to the specific embodiments disclosed in the specification and the claims, but should be construed to include all types of dispensers, organizers and methods of making the same that operate in accordance with the claims. Accordingly, the invention is not limited by the disclosure, but instead its scope is to be determined entirely by the following claims.

What is claimed is:

1. A dispenser adapted to be mounted to a structure wall and to allow

Consumables to be dispensed from a consumables box, the dispenser comprising:

a front wall defining an aperture, where the front wall extends completely around the aperture;

at least one back wall;

first and second walls each extending between the front wall and the at least one back wall: and at least one support wall extending from at least one of the front wall, the at least one back wall, and the first and second walls; whereby the aperture in the front wall is configured to allow the consumables to be extracted from the consumables box:

prior to attachment of the dispenser to the structure wall, the at least one back wall is configured to allow deformation of the at least one back wall;

the dispenser is attached to the structure wall by securing the at least one back wall to the structure wall, where, after attachment of the dispenser to the structure wall, the at least one back wall is fixed; and the consumables box is supported by the at least one support wall such that a first portion defined by the at least one back wall is configured to engage the consumables box, a second portion defined by one of the first and second walls is configured to engage the consumables box, and when the dispenser is attached to the structure wall, the front wall and the at least one back wall inhibit displacement of the first and second walls relative to each other; and the front wall is configured to inhibit flexing of the dispenser when the at least one back wall and the first and second walls engage the consumables box.

2. A dispenser as recited in claim 1, in which:

the first portion defines a first spring mechanism;

the second portion defines a second spring mechanism;

the first spring mechanism applies a first outward force on at least one wall of the dispenser; and the at least one second spring mechanism applies a second outward force on at least one wall of the dispenser.

3. A dispenser as recited in claim 1, in which:

the at least one back wall comprises a plurality of back walls; and the front wall, the plurality of back walls, the first and second walls, and at least one support wall are formed from a single sheet of material.

4. A dispenser as recited in claim 2, in which the at least one first spring mechanism is integrally formed with at least one of the back walls.

5. A dispenser as recited in claim 2, in which the at least one second spring mechanism is integrally formed with at least one of the first and second walls.

6. A dispenser as recited in claim 5, in which a second outward force is applied on at least one of the first and second walls of the dispenser.

7. A dispenser as recited in claim 2, in which:

the first spring mechanism is integrally formed with the at least one back wall; and the second spring mechanism is integrally formed with at least one of the first and second walls.

8. A dispenser as recited in claim 2, in which:

the at least one first spring mechanism is integrally formed with one of the plurality of back walls; and the at least one second spring mechanism is integrally formed with each of the first and second walls.

9. A dispenser as recited in claim 1, in which at least one mounting aperture is formed in each of the back walls.

10. A dispenser as recited in claim 1, in which the at least one support wall extends from each of the front wall, the back walls, and the first and second walls.

11. A method of allowing consumables to be dispensed from a consumables box, the method comprising the steps of:

providing a dispenser comprising a front wall defining an aperture, where the front wall extends completely around the aperture;

at least one back wall;

first and second walls each extending between the front wall and the at least one back wall; and at least one support wall extending from at least one of the front wall, the at least one back wall, and the first and second walls;

configuring the front wall to allow the consumables to be extracted from the consumables box and to inhibit flexing of the dispenser when the at least one back wall and the first and second walls engage the consumables box:

configuring the at least one back wall to allow deformation of the at least one back wall prior to attachment of the dispenser to the structure wall;

attaching the dispenser to the structure wall by securing the at least one back wall to the structure wall, where, after attachment of the dispenser to the structure wall, the at least one back wall is fixed; and supporting the consumables box by the at least one support wall such that a first portion defined by the at least one back wall is configured to engage the consumables box, a second portion defined by one of the first and second walls is configured to engage the consumables box, and when the dispenser is attached to the structure wall, the front wall and the at least one back wall inhibit displacement of the first and second walls relative to each other.

12. A method as recited in claim 11, further comprising the steps of:

configuring the first portion to define a first spring mechanism that applies a first outward force on at least one wall of the dispenser when the consumables box is supported by the at least one support wall;

configuring the second portion to define a second spring mechanism that applies a second outward force on at least one wall of the dispenser when the consumables box is supported by the at least one support wall.

13. A method as recited in claim 12, in which:

the first spring mechanism is integrally formed with the at least one back wall; and the second spring mechanism is integrally formed with at least one of the first and second walls.

14. A method as recited in claim 12, in which:

the at least one first spring mechanism is integrally formed with one of the plurality of back walls; and the at least one second spring mechanism is integrally formed with each of the first and second walls.

15. A method as recited in claim 11, in which the at least one support wall extends from each of the front wall, the back walls, and the first and second walls.

16. A dispenser adapted to be mounted to a structure wall and to allow consumables to be dispensed from a consumables box, the dispenser comprising:

a front wall defining an aperture, where the front wall extends completely around the aperture;

a plurality of back walls, where at least one first projection is integrally formed in at least one of the back walls, and at least one mounting aperture is integrally formed in each of the back walls;

first and second walls each extending between the front wall and one of the back walls, where at least one second projection is integrally formed in at least one of the first and second walls supports; and at least one support wall extending from each of the front wall, the back walls, and the first and second walls; whereby the aperture in the front wall is configured to allow the consumables to be extracted from the consumables box;

prior to attachment of the dispenser to the structure wall, the back walls are spaced from each other such that the back walls are capable of moving relative to each other;

the dispenser is attached to the structure wall by securing the back walls to the structure wall, where, after attachment of the dispenser to the structure wall, the back walls are fixed relative to each other: and the consumables box is supported by the at least one support wall using the at least one mounting aperture such that the first projection engages the consumables box, the at least one second projection engages the consumables box, outward forces on the front wall of the dispenser is transmitted to the structure wall through the first and second walls and the back walls, and outward forces on the first and second walls of the dispenser are transmitted to the structure wall through the back walls; and the front wall is configured to inhibit flexing of the dispenser when the first and second outward forces are applied to the dispenser.

17. A dispenser as recited in claim 16, in which the at least one first projection defines a first spring mechanism; the at least one second projection defines a second spring mechanism; the first spring mechanism applies a first outward force on at least one wall of the dispenser; and the at least one second spring mechanism applies a second outward force on at least one wall of the dispenser.

18. A dispenser as recited in claim 17, in which:

the at least one first spring mechanism is integrally formed with one of the plurality of back walls; and the at least one second spring mechanism is integrally formed with each of the first and second walls.

19. A dispenser as recited in claim 16, in which the at least one support wall extends from each of the front wall, the back walls, and the first and second walls.

* * * * *